US006065806A

United States Patent [19]

Miyaguchi et al.

[11] Patent Number: 6,065,806

[45] Date of Patent: May 23, 2000

[54] MASSAGING DEVICE

[75] Inventors: Masamichi Miyaguchi; Makoto Fukutani; Fumihiro Nishio; Haruo Sugai, all of Hikone; Eiji Masutani; Naoto Sayama, both of Shiyoa-gun, all of Japan

[73] Assignee: Matsushita Electric Works, Ltd., Saitama, Japan

[21] Appl. No.: 09/147,331

[22] PCT Filed: Apr. 28, 1998

[86] PCT No.: PCT/JP98/01960

§ 371 Date: Dec. 3, 1998

§ 102(e) Date: Dec. 3, 1998

[87] PCT Pub. No.: WO98/48762

PCT Pub. Date: Nov. 5, 1998

[30] Foreign Application Priority Data

Apr. 30, 1997 [JP] Japan ..... 9-113102

[51] Int. Cl.[7] ..... A47C 1/032; A61H 15/00

[52] U.S. Cl. ..... 297/362.13; 297/217.3; 297/327; 601/49

[58] Field of Search ..... 297/27, 28, 217.3, 297/284.5, 325, 326, 327, 328, 362.13; 601/49

[56] References Cited

U.S. PATENT DOCUMENTS

| | | | |
|---|---|---|---|
| 2,132,525 | 10/1938 | Burchall | 297/27 |
| 2,776,704 | 1/1957 | Moore et al. | 297/27 |
| 5,813,727 | 9/1998 | Sugawa et al. | 297/217.3 |
| 5,836,900 | 11/1998 | Leventhal | 297/284.5 X |
| 5,899,530 | 5/1999 | Tedesco | 297/326 X |

FOREIGN PATENT DOCUMENTS

| | | |
|---|---|---|
| 4-38752 | 9/1992 | Japan . |
| 5-36425 | 9/1993 | Japan . |
| 6-125957 | 5/1994 | Japan . |
| 7-53620 | 12/1995 | Japan . |
| 7-56017 | 12/1995 | Japan . |
| WO98/48762 | 11/1998 | WIPO . |

*Primary Examiner*—Peter R. Brown
*Attorney, Agent, or Firm*—Arent Fox Kintner Plotkin & Kahn, PLLC

[57] ABSTRACT

A massaging device capable of easily achieving a reclining operation. The massaging device of the present invention includes a base supporting a seat and a backrest rotatable about a pivot axis about a limited angular range. Mounted within the backrest is a massaging mechanism which includes an applicator giving a massaging action to a user. A pair of armrests extend on opposite sides of the seat and the backrest. The massaging device includes a reclining mechanism for selectively holding the backrest at a position about the pivot axis within the angular range and permitting the bracket to rotate about the pivot axis within the angular range. A handle, which is connected to actuate the reclining mechanism for permitting the backrest to rotate, is mounted on a lower surface of one of the armrests at a location upwardly of the seat. With this arrangement, the handle can be within a reach of the user s fingers even the backrest is fully inclined to a leaned position, and therefore could be easily manipulated by the user. Also, since the handle is mounted on the lower surface of the armrest, it is free from being inadvertently actuated when the handle is not intended to be operated.

6 Claims, 5 Drawing Sheets

MASSAGING DEVICE

TECHNICAL FIELDS

The present invention relates to a massaging device of a chair-type with a reclining backrest which incorporates a massaging mechanism of producing a massaging action.

BACKGROUND ART

For a massaging device with a backrest incorporating a massaging mechanism, a user can enjoy being massaged in a more relaxed manner with the backrest being reclined. Thus, the backrest is pivotally supported to a base to be rotatable about a pivot axis within a limited angular range and is caused by a reclining mechanism to freely rotate to a desired angular position and is held thereat. The reclining mechanism includes a gas-filled cylinder, an extensible plunger extending from the cylinder, and an actuator provided at one end of the plunger. One of the cylinder and the plunger is connected to a base, while the other of the cylinder and the plunger is pivotally connected to a lower end of the backrest at a point spaced from the pivot axis. The actuator is provided to open and close an internal valve of the cylinder for permitting a gas to move within the cylinder upon being actuated and therefore permitting the plunger to move relative to the cylinder, thereby causing the backrest to rotate about the pivot axis in correspondence to a load applied to the backrest. The actuator is connected to be actuated by operating a handle mounted on the base at a position below the seat. Due to the structural restriction that the actuator is provided on the side of the plunger, the handle for moving the actuator is located on a portion of the base below the seat and the backrest and adjacent to the reclining mechanism. Although thus located handle can be reached by a user's finger when the backrest is in an upright position, it is difficult to be reached by the fingers when the backrest is in a leaned position.

DISCLOSURE OF THE INVENTION

The present invention has been accomplished in view of the above insufficiency and has an object of providing a massaging device which is capable of easily achieving a reclining operation. The massaging device in accordance with the present invention includes a base supporting a seat and a backrest rotatable about a pivot axis about a limited angular range. Mounted within the backrest is a massaging mechanism which includes an applicator giving a massaging action to a user. A pair of armrests extend on opposite sides of the seat and the backrest. The massaging device includes a reclining mechanism for selectively holding the backrest at a position about the pivot axis within the angular range and permitting the bracket to rotate about the pivot axis within the angular range. A handle, which is connected to actuate the reclining mechanism for permitting the backrest to rotate, is mounted on a lower surface of one of the armrests at a location upwardly of the seat. With this arrangement, the handle can be within a reach of the user's fingers even the backrest is fully inclined to a leaned position, and therefore could be easily manipulated by the user. Also, since the handle is mounted on the lower surface of the armrest, it is free from being inadvertently actuated when the handle is not intended to be operated.

Preferably, the seat is fixed to the backrest to be rotatable about the pivot axis together with the backrest. The handle is located upwardly of thus rotatable seat irrespective of any angular position of the backrest permitted to rotate about the pivot axis.

Each of the armrests is of a hollow structure and shaped into an upwardly convexed arcuate configuration and is connected at opposite arcuate ends thereof to a hollow support member fixed to the base. The reclining mechanism comprises a cylinder, an extensible plunger extending from the cylinder, and an actuator projecting from said plunger to permit the plunger to extend and retract from the cylinder when being pressed and otherwise lock the plunger. The cylinder is connected to the base at one end opposite of the plunger, while the plunger is connected at a distal end thereof to a lower end of the backrest at a point spaced from the pivot axis so as to rotate the backrest about the pivot axis in accordance with varying extending length of the plunger from the cylinder. The handle is connected through a cable to the actuator in order to permit the plunger to move relative to the cylinder by operating the handle. The cable is routed from the handle through a portion of the armrest, and a portion of the support member and is led to the lower end of the backrest for activating the actuator. In this fashion, the cable can be routed by utilization of the armrest and the supporting member to the actuator of the reclining mechanism below the backrest, enabling to connect the handle on the armrest to the reclining mechanism without exposing the cable on the side of the chair.

The support member is also of a hollow structure shaped into a downwardly convexed arcuate configuration and is connected at opposite arcuate ends thereof to the opposite arcuate ends of the armrest.

These and other advantageous features of the present invention will become apparent from the following detailed description of the preferred embodiments when taken in conjunction with the attached drawings.

BEST MODE FOR CARRYING OUT THE INVENTION

Figure 1:
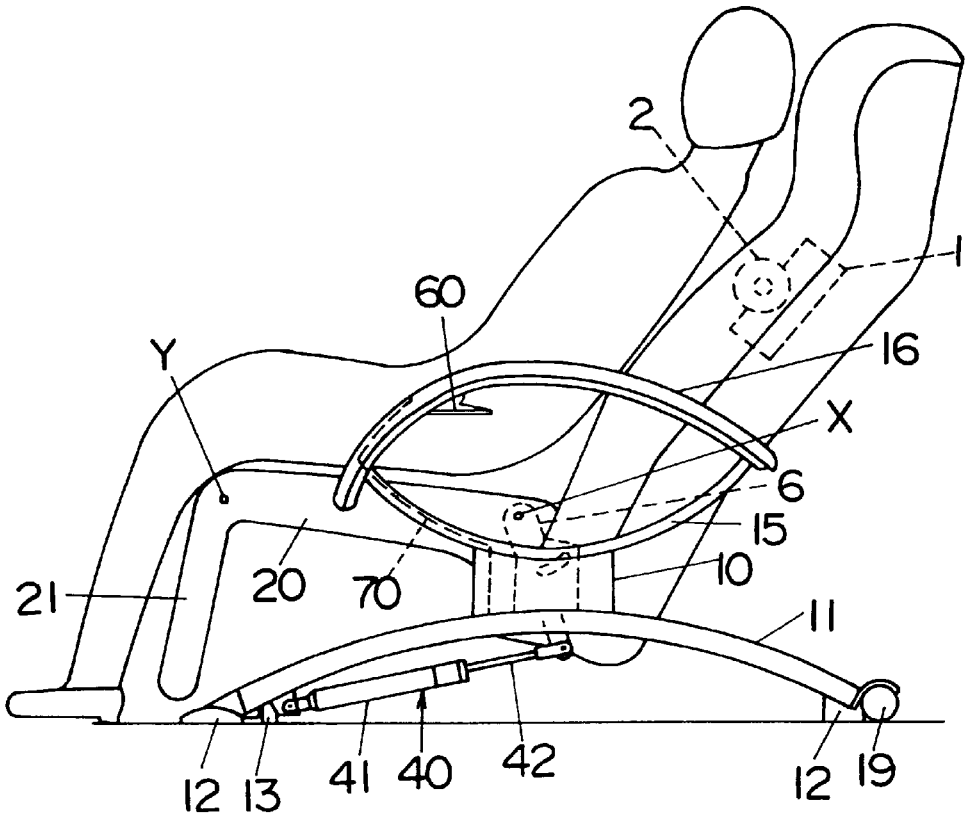
FIG. 1 is a side view of a massaging device in accordance with one embodiment of the present invention.
Figure 2:
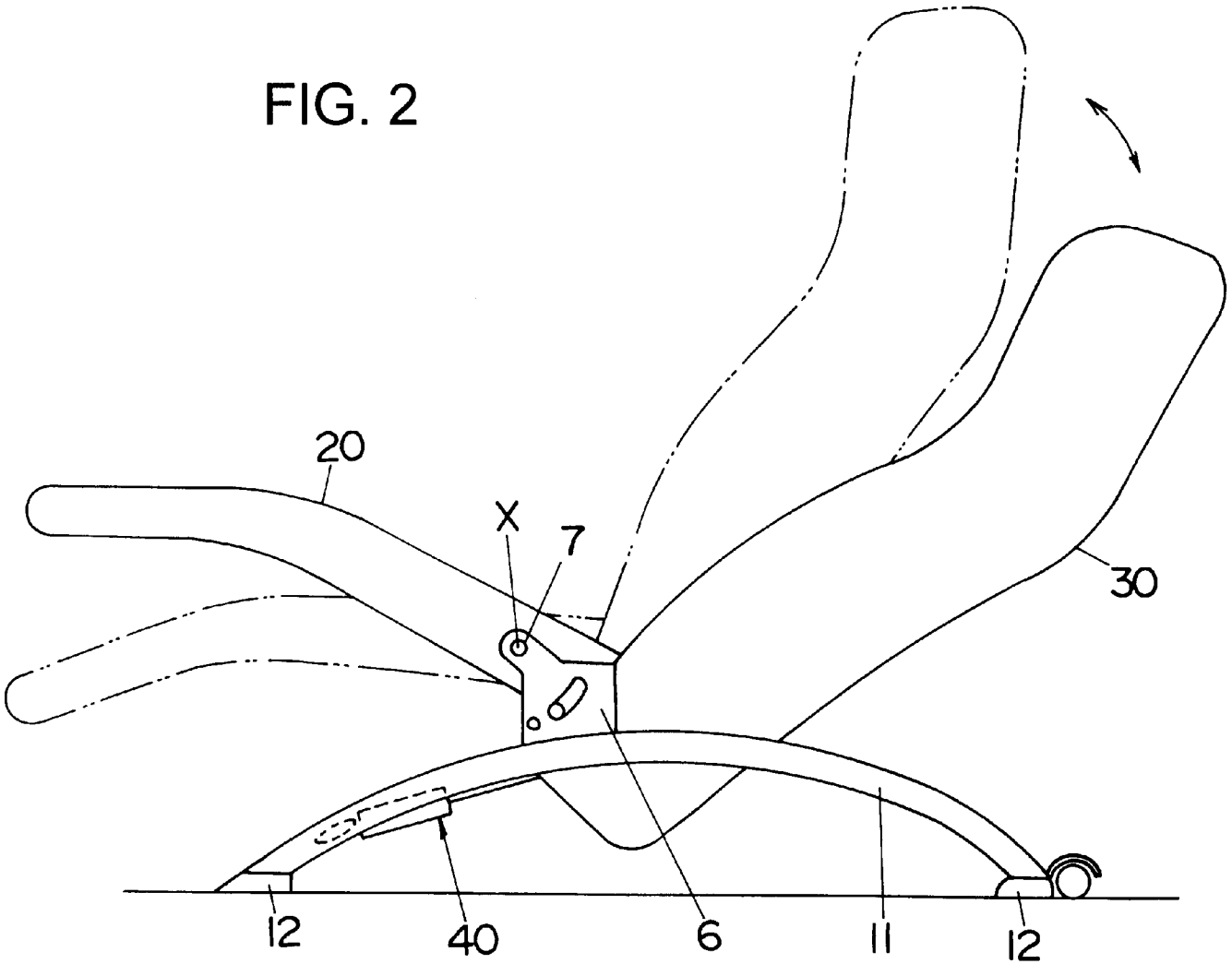
FIG. 2 is a schematic view illustrating a reclining operation of a backrest of the above device.

FIG. 1 illustrates a chair-type massaging device in accordance with a preferred embodiment of the present invention, which has chair's backrest 30 mounting therein a massaging mechanism 1 with an applicator 2. The massaging device includes a base 10 with a pair of legs 11, and a combination of a seat 20 and the backrest 30 mounted to the base 10. The seat 20 and the backrest 30 is integrally secured by a member 6 and is pivotally supported to the base 10 by means of a pin 7 so as to be rotatable about a pivot axis X within a predetermined angular range. Each of the legs 11 is shaped into an upwardly convexed arcuate configuration and is provided at its opposite ends with foot stands 12 and is provided at its rear end with a wheel 19 for transportation of the device. The legs 11 are connected at their front ends by a crossbar 13 which is connected to the backrest 30 by means of a reclining mechanism 40. The reclining mechanism 40 comprises a gas-filled cylinder 41 and an extensible plunger 42 extending from the cylinder 41. The cylinder 41 has its one end connected to the crossbar 13 at the front end of the legs 11, while the plunger 42 has its one end connected to the lower end of the backrest 30. The reclining mechanism 40 includes an actuator 43 which, upon being actuated, opens an internal valve of the cylinder 41 to permit a filled gas to move within the cylinder 41 and therefore permit the plunger 42 to move relative to the cylinder 41. That is, the plunger 42 has a piston having the valve at its one end within the cylinder so that the gas within the cylinder will flow through the valve of the piston to move the plunger 42 relative to the cylinder 41. Thus, the backrest 30 can be angled in accordance with a load applied to the backrest so that the backrest 30 can rotate together with the seat 20 in a reclining manner, as shown in FIG. 2. When no load is applied to the backrest 30, the backrest 30 is urged to rotate towards a raised position by the gas pressure in the cylinder 41. When a load greater than the gas pressure is applied, the backrest 30 is caused to lean backward slowly against the gas pressure. Projecting from the front end of the seat 20 is a foot stand 21 which is rotatable about a pivot axis Y.

Secured to the seat 20 on opposite sides thereof are supporting members 15 of arcuate configuration which support armrests 16 of upwardly convexed arcuate configuration. The supporting member 15, which is of downwardly convexed arcuate configuration and of a hollow structure, is connected at its front and rear ends to front and rear ends of the armrest 16. The armrest 16 is also of a hollow structure and communicates with the interior of the supporting member 15 at the connection between the front end of the armrest and the supporting member. Provided on the lower surface of the center of the armrest 16 is a lever-shaped handle 60 to which one end of a cable 70 is connected. The cable extends through the armrest 16 and the supporting member 15 to be connected to operate the actuator 43 of the reclining mechanism 40 below the backrest 30. For this purpose, the cable 70 extends out of a center opening of the supporting member 15 towards a portion below the backrest 30.

Figure 3:
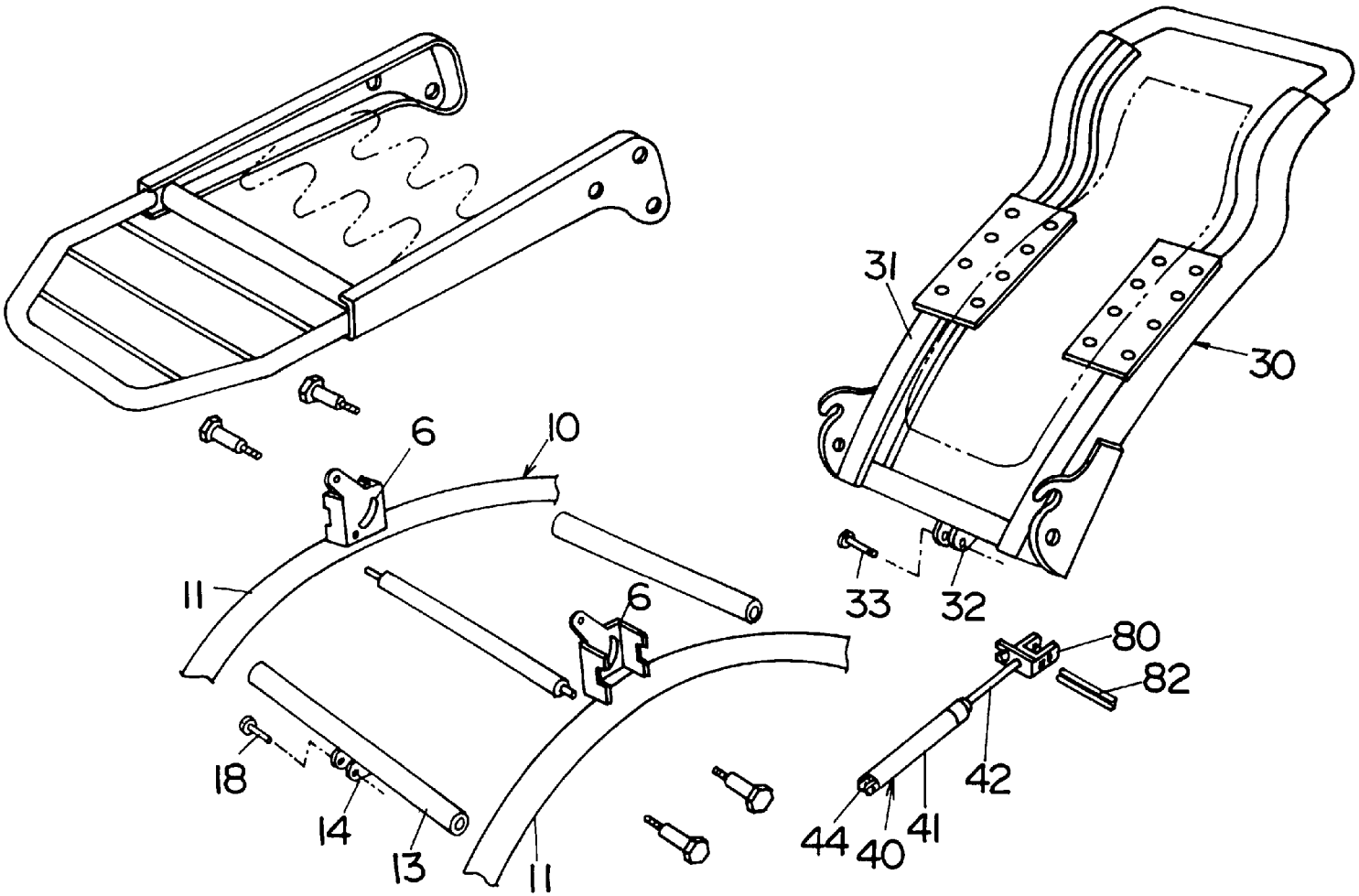
FIG. 3 is an exploded perspective view illustrating an internal structure of the above massaging device.
Figure 4:
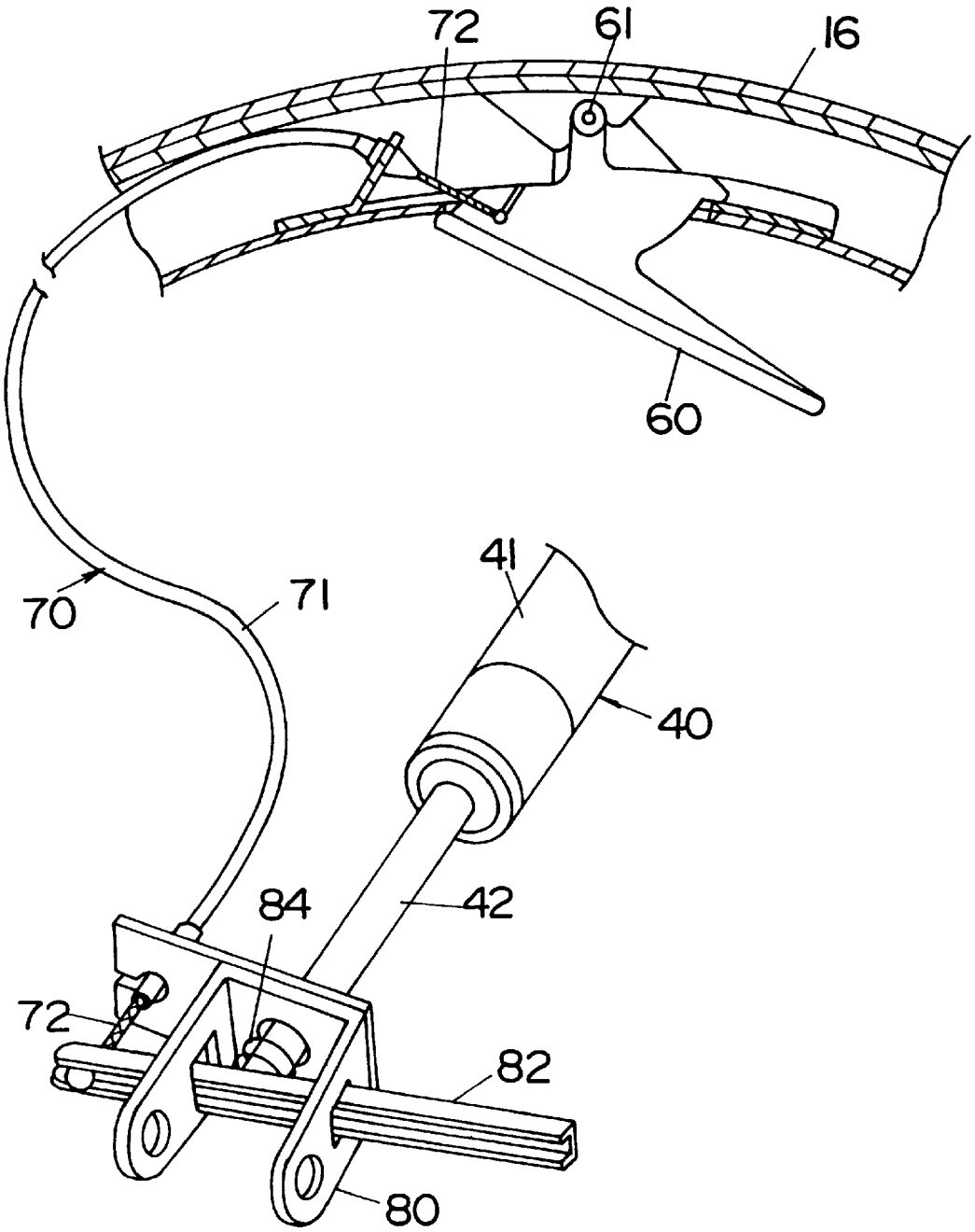
FIG. 4 is a schematic view illustrating a connection between a reclining mechanism of the above massaging device and a handle.
Figure 5:
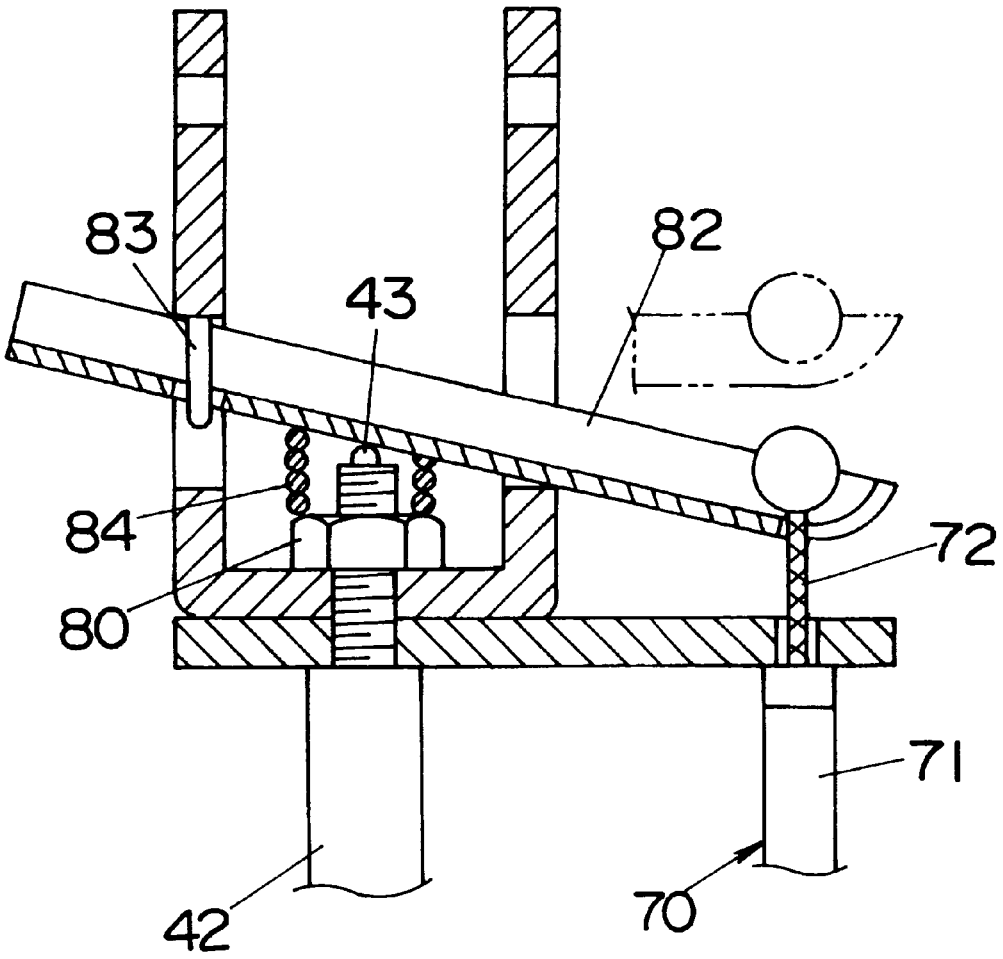
FIG. 5 is a partially sectional view illustrating a connection of the reclining mechanism to the backrest.

As shown in FIG. 4, the cable 70 is composed of a sheath 71 and a core wire 72. The sheath 71 is secured at its opposite ends to the armrest 16 and a bracket 80 fixed to the end of the plunger 42. The handle 60 is pivotally mounted to the armrest 16 by means of a pin 61 and is connected to one end of core wire 72 at a position offset from the pin 61. The other end of the core wire 72 is connected to a lever 82 supported to the bracket 80. As shown in FIG. 3, the bracket 80 is pivotally supported by means of a pin 33 to a member 32 projecting at the lower end of a frame 31 of the backrest 30, connecting the plunger 42 to the backrest 30. The cylinder 41 is connected by means of a pin 18 to a member 14 of the crossbar 13 bridging between the front ends of the legs 11. As shown in FIGS. 4 and 5, the lever 82 is pivoted at its one end to the bracket 80 by means of a pin 83 in an engageable relation to the actuator 43 projecting at the end of the plunger 42 so that the actuator 43 is pressed as the lever is moved in one direction with the core wire 72 being pulled by operation of the handle 60 and that the actuator 43 is released as the lever 82 is urged by a spring 84 disposed between the bracket 80 and the lever 82 upon release of the handle 60. When the actuator 43 is pressed by operation of the handle 60, the internal valve of the cylinder 41 is opened to permit the flow of the filled-gas, thereby enabling the plunger 42 to move relative to the cylinder 41 for shifting the backrest 30 to a desired angular position. Upon release of the handle 60, the actuator 43 is returned to a position of closing the internal valve, disabling the movement of the plunger 42 and therefore keeping the backrest 30 at the instant position.

As described in the above, because the handle 60 responsible for operating the reclining mechanism 40 to recline the backrest 30 together with the seat 20 is disposed above the seat as well as on the lower surface of the armrest 16, the handle 60 can be located well within a reach of the fingers of the user irrespective of the position of the backrest 30, thereby facilitating the reclining operation in a comfortable manner.

The massaging mechanism 1 incorporated in the backrest 30 of the chair-type massaging device may be that disclosed in Japanese Patent Laid-Open Publication No. 63-145656 in which a pair of ring members are provided around a drive shaft in an eccentric relation as well as in an inclined relation to the axis of the drive shaft, and a roller-shaped applicator is provided at an end of an arm projecting from a freely rotatable member of each ring member. In this mechanism, the applicator gives a kneading massage action to the user's body in response to the rotation of the drive shaft by a motor, while running the whole massaging mechanism along the backrest 30 can select the portion being massaged or give a rubbing massage action.

We claim:

1. A massaging device which comprises:

a base located beneath and supporting a seat and a backrest, said backrest being pivotally supported to said base about a pivot axis to be rotatable about said pivot axis within an angular range;

a massaging mechanism with an applicator, said massager being disposed within said backrest in order that said applicator applies a massaging action to the user;

a pair of armrests supported by said base to extend on opposite sides of said seat and said backrest;

a reclining mechanism having a first end always connected to said base beneath said seat and a second end connected directly to said backrest to selectively hold said backrest at a position about said pivot axis within said angular range and permit said backrest to rotate about said pivot axis within said angular range; and a handle connected to actuate said reclining mechanism for permitting said backrest to rotate, wherein said handle is mounted on a lower surface of one of said armrests at a location upwardly of said seat.

2. The massaging device as set forth in claim 1, wherein said seat is fixedly connected to said backrest to be rotatable about said pivot axis together with said backrest.

3. The massaging device as set fortn in claim 2, wherein said position of said handle is selected to be upwardly of said seat in any angular position of said backrest permitted to rotate about said pivot axis.

4. The massaging device as set forth in claim 2, wherein each of said armrests is of a hollow structure and shaped into an upwardly convexed arcuate configuration and is connected at opposite arcuate ends thereof to a hollow support member fixed to said base, said reclining mechanism comprising a cylinder, an extensible plunger extending from said cylinder, and an actuator projecting from said plunger to permit said plunger to extend and retract from said cylinder when being pressed and otherwise lock said plunger;

said cylinder being connected to said base at one end opposite of said plunger;

said plunger being connected at a distal end thereof to a lower end of said backrest at a point spaced from said pivot axis so as to rotate said backrest about said pivot axis in accordance with varying extending length of said plunger from said cylinder;

said handle being connected through a cable to said actuator in order to permit said plunger to move relative to said cylinder by operating said handle, said cable being routed from said handle through a portion of said armrest, and a portion of said support member and led to the lower end of said backrest for activating said actuator.

5. The massaging device as set forth in claim 4, wherein said support member is of a hollow structure shaped into a downwardly convex arcuate configuration and is connected at opposite arcuate ends thereof to said opposite arcuate ends of said armrest.

6. The massaging device as set forth in claim 4, wherein said base includes a pair of legs extending generally horizontally on opposite sides of said seat, said legs having front ends which are connected by a transverse beam at a portion below a front end of said seat, said cylinder being connected to said transverse beam.

* * * * *

UNITED STATES PATENT AND TRADEMARK OFFICE

CERTIFICATE OF CORRECTION

PATENT NO. : 6,065,806

DATED : May 23, 2000

INVENTOR(S) : MIYAGUCHI et al.

It is certified that error appears in the above-identified patent and that said Letters Patent is hereby corrected as shown below:

Item [73], please delete "Matsushita Electric Works, Ltd., Saitama, Japan" and insert therefor, -- Matsushita Electric Works, Ltd., Osaka, Japan; TS Tech Co., Ltd., Saitama, Japan --

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*